US010675210B2

(12) United States Patent
Newton et al.

(10) Patent No.: US 10,675,210 B2
(45) Date of Patent: Jun. 9, 2020

(54) INFLATION PRESSURE GARMENTS AND CONNECTORS

(71) Applicant: HUNTLEIGH TECHNOLOGY LIMITED, Bedfordshire (GB)

(72) Inventors: Michael David Newton, South Glamorgan (GB); David John Cain, Bedfordshire (GB); Donald Martin Beach, Bedfordshire (GB)

(73) Assignee: Huntleigh Technology Limited (GB)

( * ) Notice: Subject to any disclaimer, the term of this patent is extended or adjusted under 35 U.S.C. 154(b) by 610 days.

(21) Appl. No.: 15/390,561

(22) Filed: Dec. 26, 2016

(65) Prior Publication Data

US 2017/0105894 A1 Apr. 20, 2017

Related U.S. Application Data

(63) Continuation-in-part of application No. PCT/GB2015/051866, filed on Jun. 26, 2015.

(30) Foreign Application Priority Data

Jun. 26, 2014 (GB) ..... 1411370.8

(51) Int. Cl.
*A61H 9/00* (2006.01)
*A61H 23/04* (2006.01)

(52) U.S. Cl.
CPC ..... *A61H 9/0078* (2013.01); *A61H 9/005* (2013.01); *A61H 9/0007* (2013.01); *A61H 23/04* (2013.01); *A61H 2201/1238* (2013.01); *A61H 2205/084* (2013.01); *A61H 2205/106* (2013.01); *A61H 2205/12* (2013.01); *A61H 2209/00* (2013.01)

(58) Field of Classification Search
CPC .... A61H 9/0078; A61H 9/0007; A61H 9/005; A61H 2201/165; A61H 2201/5007; A61H 2201/5038; A61H 2201/5041; A61H 2201/1238; A61H 2205/08; A61H 2205/084; A61H 2205/106; A61H 2205/12; A61H 2209/00; A61H 23/04; B60S 5/046; G06K 19/0723
See application file for complete search history.

(56) References Cited

U.S. PATENT DOCUMENTS 6,884,255 B1 * 4/2005 Newton ..... A61H 9/0078 606/202
2005/0235988 A1 10/2005 Hansen et al.
2008/0077176 A1 * 3/2008 Hanlon ..... A61H 9/0078 606/201

FOREIGN PATENT DOCUMENTS

CN 1274409 A 11/2000
EP 1902747 A2 3/2008
WO 1997024545 A1 7/1997
WO 2009083943 A1 7/2009

OTHER PUBLICATIONS

International Search Report and Written Opinion dated Sep. 14, 2015 in corresponding International Application No. PCT/GB2015/051866 filed Jun. 26, 2015 (12 pages).

* cited by examiner

*Primary Examiner* — Ryan J. Severson
*Assistant Examiner* — Mohamed G Gabr
(74) *Attorney, Agent, or Firm* — The Webb Law Firm

(57) ABSTRACT

A connector for an inflatable garment that detects a valid connection with a pump.

14 Claims, 13 Drawing Sheets

Garment Allocation Table

| Component | Garment Short Connector | Garment Long Connector |
|---|---|---|
| Short Ferrite | Garment 1 | Not Used |
| Long Ferrite | Not Possible - unable to physically fit | Garment 2 |
| Size 1 | Garment 3 | Not Used |
| Size 2 | Not Possible - unable to physically fit | Garment 4 |
| Size 3 | Used for Extension Tube | Not Used |

Note: Garment 5 could be a garment from a different supplier that had a commercially available similar connector but without an identification component and is therefore not compatible with the extension device.

FIG. 2

Pump Compatibility Table

| Garment # | Pump A (accommodates all connectors) | Pump B (accommodates only short connector) | Pump C (accommodates all connectors) |
|---|---|---|---|
| Garment 1 | Yes | Yes | Yes |
| Garment 2 | Yes | No | No |
| Garment 3 | Yes | Yes | No |
| Garment 4 | | Yes - only via the extension device | No |
| Garment 5 | No | No | No |

FIG. 3

INFLATION PRESSURE GARMENTS AND CONNECTORS

This is application is a continuation-in-part, pursuant to 35 USC 365(c), of International Patent Application No. PCT/GB2015/051866, filed on Jun. 26, 2015, which in turn claims the benefit of priority to British Patent Application No. GB 1411370.8, filed on Jun. 26, 2014, all the foregoing are incorporated herein by reference in their entirety.

FIELD OF THE DISCLOSURE

The present disclosure relates to the connectors of inflatable pressure cuff(s) or garment(s), particularly those suitable for deep vein thrombosis prophylaxis, but which also have utility in other areas of medical treatment and diagnostics.

BACKGROUND OF THE DISCLOSURE

In a clinical setting, it is advantageous that medical products, particularly systems formed from multiple separate connecting elements, automatically configure and operate together in a safe and effective manner. It is also beneficial that incorrect or non-approved combinations of system elements are prevented from operating. In addition, it is helpful if the user is provided with feedback on the status of the system configuration.

This is particularly the case in areas of patient care where medical staff are busy with other essential activities, focused on more critical aspects, such as surgical and intensive care activities or where staff have a limited understanding of the operation, and function of the specific medical equipment.

Further, there are many devices found in the healthcare environment that share similar types of fluidic connectors that can be easily mistaken by the user as being compatible. Many similar devices use standard commercially available connectors and tubes and these, therefore, can potentially be a source of confusion to the healthcare professional.

In contrast, it is advantageous to a medical device manufacturer to be able to use a standard size of connection hose on a variety of different garments. This ensures that there is a sufficiently large path provided for fluid flow to allow for a correct inflation. This is also the case when a connector is selected, wherein it is beneficial to have a standard connector type that has a capability to be configured in some manner for product specific use. In particular, being able to maintain the same connector barrel diameter across various products allows for advantages in equipment design and management. For example, in the field of compression garments, these devices often share a standard diameter air tube (e.g. 3/16 inch diameter) and an air connector.

Hence, at first inspection, many different devices appear to be readily compatible between the various different suppliers of garments and pumps. However these devices are often not readily functionally cross-compatible and, as a result, are specifically not licensed or regulatory approved for use in combination. It is also possible that there are patient hazards associated with this inappropriate use, so there is a patient safety benefit to achieve by avoiding the misuse of items in this manner.

Therefore, manufacturers typically try to find methods, often involving subtle design differences involved that can be used to prevent actual misuse or incorrect compatibility—such as mechanical keying, labelling or other more advanced automatic means. However the use of these design differences is not always fully advantageous as they are often not immediately apparent to the user as the connectable items sometime initially appear to partially connect together, but the resulting operation will not be correct.

The various connectors used on similar pumps, and the various mating connectors used on various garments, can all look very similar. So it is relatively easy to mistake which combination of pumps and garments are intended to operate in combination with each other.

It is often the case that equipment is physically set up ready for a patient, in advance of clinical need, wherein the user mistakenly believes the equipment is connected correctly and ready for use. As a result of this error, when the equipment is eventually put into use, possibly by different members of clinical staff, the required therapy will not be delivered and the resulting lack of functionality can result in alarms and warnings generated and, therefore, cause clinical delay and complications.

The automatic detection of the connected garment by a pump can provide a solution to this problem by detecting the presence of a valid connection. This approach is already well known in the prior art, indeed the applicants own patent (e.g. U.S. Pat. No. 6,884,255) provides for such a mechanism using a component built into the fluid connector and this component is automatically detected and identified. This approach provides both positive and negative feedback in both a visible and audible manner regarding the suitability of the garment using the user interface of the pump. However, this approach does require the user to take note of the information being provided on the user interface and is only operational when the pump is powered.

SUMMARY OF THE DISCLOSURE

It is an aspect of the present disclosure that this situation is addressed by combining an improved mechanical physical connection arrangement with the operation of the automatic detection process.

There are situations where the user needs an immediate understanding of the compatibility of elements of the system, often at the point of physical connection, which can be remote from the traditional source of feedback. An example of this is when connecting a garment to an extension hose that is itself connected to a pump. The pump can be located in an area of the medical environment that is difficult to access or obscured from the point of connection. Hence, the visual feedback at the pump is not beneficial to the user—instead some form of positive feedback is required. This can be through the use of color coded aspects of the connector or a distinctly evident lack of connection—for example, through the use of sizing of connector components.

The present disclosure employs a physical change to the barrel of the connector, primarily involving a length extension, as a result of which the different connector is visually very pronounced. Also, since the barrel length is too long to fit into a device that is not intended to be compatible with the connector, there is a lack of mechanical fit. A further aspect of the present disclosure is that the longer barrel also allows an increased space within the barrel for the mounting of larger components used to provide an automatic garment detection and identification function. The benefit of the longer connector barrel, in accordance with this disclosure, is that when the user tries to insert it in a non-compatible connector of the same diameter and style they obtain an immediate feedback that the garment and its connector is not compatible because it is physically too long to insert. This avoids any misuse errors at the point of connection.

Thus, a further aspect of this disclosure lies in the combination of the longer barrel mechanical engagement and the associated benefits of the longer barrel where it can accommodate a longer automatic detection component than was previously possible.

The present disclosure also pertains to the form of improvements and changes to the current garment identification system. This involves elements located on the garments, any new identifiable extension hose sets located between garment and pump outlet, the pump-mounted hose set, and within the pump itself.

The connector, in accordance with an embodiment of this disclosure, includes a ferrite component with a toroid shape leading edge, which has an improved interface with the mounting ribs, which is similar in effect to a chamfer, and allows the easier insertion of the ferrite component into the barrel of the connector before the rib compression occurs. It avoids damage to mounting ribs located within the connector barrel during insertion.

Advantages of using a toroidal shape rather than a cylindrical shape are that the ribs used to mount the ferrite are protected during the initial part of the ferrite insertion and, as a result, allow for a more effective interface between the outer diameter of the ferrite and the internal compression ribs within the connector barrel. This is of particular benefit as the connector is normally molded of a soft plastic, such as Polyvinylchloride (PVC) or Polyethylene (PE). The use of a softer plastic provides benefits to the compressible rib operation and to the mounting of the garment tubing at the proximal connector end, thus providing the air path to the inflatable chamber.

One issue when using a longer barreled connector is to provide an easy insertion process for the user, such as an insertion process with a low insertion force that increases as the degree of insertion increases. This provides improved tactile feedback to the user that the connector is intended to fit. Hence, a further aspect of an embodiment of this disclosure includes the use of a connector barrel with a smaller outer diameter at the most distal point than is present further proximally on the barrel. This structural configuration allows the garment connector to be inserted into the mating connector in an easier manner by providing a lead-in and allowing the user to insert the connector at a slight angle. The initial insertion force is very low until the larger diameter of the barrel becomes engaged in the connector.

One manner of achieving this benefit is for the most distal point of the connector barrel to be stepped or chamfered compared to other parts of the barrel. This is undertaken at a distal position of the barrel before the majority of the component body to ensure the elongated connector barrel has some flexibility at the tip. The insertion of the component into the barrel provides stiffening more proximally to the connector during the insertion process.

A further aspect of an embodiment of this disclosure involves the use of a removable extension device that forms an accessory and can be used to connect inflatable garments to a pump. The extension device consists of at least a first connector (intended for connection to a pump), a second connector (intended for connection to a garment) and an identification component located in the barrel of the first connector. The identification component is located within the barrel of the connector, and the identification component is made from ferrite or brass and has a longitudinal length that is >3 mm. In accordance with this disclosure, an embodiment includes a number of different extension devices, each intended to offer a different compatibility path between garments and pumps. Each extension device is capable of having differing forms of the second connector and differing identification components located in the barrel of the first connector.

One embodiment utilizes a ferrite identification component with a length of >5 mm. Further embodiments use lengths of >8 mm and >11 mm. In one embodiment, the ferrite is <13 mm as this forms the largest effective size that the connector of this disclosure can accommodate and be measurable by the sensing circuitry. From a mechanical mounting and protection standpoint, it may be of interest to position the ferrite so it is contained solely within the barrel in order to provide mechanical protection for the component.

An alternative embodiment uses a brass material for the component and may have a length of 6 mm, as this is already used as part of one garment by the applicant; however, it is also possible to use longer lengths. From a mechanical mounting and protection standpoint, it may be beneficial to position the brass so it is contained solely within the barrel in order to provide mechanical protection for the brass component.

The extension device can be in the form of an adaptor characterized with a short connecting fluid path between first and second connectors. This connecting difference can be conveniently short, for example, where the first and second connectors are formed from a single plastic molding or where the first and second connectors are separate but held together in a rigid manner. This is typically found when the distance from first connector to second connector is <30 mm.

Alternatively, the extension can be characterized in the form of a longer fluid path with flexible tubing providing a longer connecting fluid path between first and second connectors.

This tubing could be as short as 30 mm, or considerably greater, with the flexible tubing providing the majority of the connection distance between pump and patient's limb.

A further aspect of the invention is the use of differing connector types and styles resulting in the first device connector not being fluidically compatible with that of the second device connector. Hence, it is possible to use the extension device as a converter for garments with a type of connector not otherwise compatible with those present on the pump.

Thus, in accordance with a first non-limiting illustrative embodiment of this disclosure, an inflatable garment is provided that comprises (a) at least one inflatable chamber, (b) a connecting fluid tube, (c) a fluid connector in fluidic connection with the inflatable chamber, wherein the fluid connector has a circular barrel, and the barrel has both a longitudinal length, an inside diameter and an outside diameter, (d) a component located inside the barrel, wherein the barrel length is elongated so that it allows the garment connector to connect fluidically inside a first mating connector type but not to fluidically connect inside a second mating connector type, wherein the internal diameters of the first and second mating connectors are substantially similar. In accordance with a second non-limiting illustrative embodiment of this disclosure, the first non-limiting embodiment is modified so that the connector barrel has an internally mounted component formed from a ferrite material. In accordance with a third non-limiting illustrative embodiment of this disclosure, the first non-limiting embodiment is modified so that the connector barrel has an internally mounted component formed from brass material. In accordance with a fourth non-limiting illustrative embodiment of this disclosure, the first, second and third non-limiting embodiments are further modified so that the connector is characterized as having an outside diameter at the connector barrel most distally that is less than the outside dimension of the barrel at a region located more proximally.

In accordance with a fifth non-limiting illustrative embodiment of this disclosure, the first, second, third and fourth non-limiting embodiments are further modified so that inflatable garment includes a fluid connector, wherein the fluid connector has a barrel, wherein the barrel contains a ferrite component mounting internally, wherein the external diameter of the fluid connector barrel is <15 mm. In accordance with a sixth non-limiting illustrative embodiment of this disclosure, the first, second, third, fourth and fifth non-limiting embodiments are further modified so that the distal internal diameter of the fluid connector barrel is greater than 75% of the distal external diameter of the fluid connector barrel. In accordance with a seventh non-limiting illustrative embodiment of this disclosure, the first, second, third, fourth, fifth and sixth non-limiting embodiments are further modified so that the diameter of the fluidic path through the component located distally in the connector barrel is >80% of the internal diameter through the attached fluid tube. In accordance with an eighth non-limiting illustrative embodiment of this disclosure, the first, second, third, fourth, fifth, sixth and seventh non-limiting embodiments are further modified so that the diameter of the fluid path through the component located distally in the connector barrel is >50% of the barrel internal distal diameter. In accordance with a ninth non-limiting illustrative embodiment of this disclosure, the first, second, third, fourth, fifth, sixth, seventh and eighth non-limiting embodiments are further modified so that the fluid path is formed in a straight line through the connector from the distal to proximal edges of the connector. In accordance with a tenth non-limiting illustrative embodiment of this disclosure, the first, second, third, fourth, fifth, sixth, seventh, eighth and ninth non-limiting embodiments are further modified so the internal diameter at the distal point of the connector barrel is greater than 120% of the diameter of the fluid path through the attached connecting tube. In accordance with an eleventh non-limiting illustrative embodiment of this disclosure, the first, second, third, fourth, fifth, sixth, seventh, eighth, ninth and tenth non-limiting embodiments of this disclosure are further modified so that the internal diameter of the fluidic path of the proximal end of the connector is greater than 70% of the internal diameter of the fluidic path at the distal end of the connector barrel.

In accordance with a twelfth non-limiting illustrative embodiment of this disclosure, the first, second, third, fourth, fifth, sixth, seventh, eighth, ninth, tenth and eleventh non-limiting embodiments are further modified so that the connector is joined to the connecting tubing by means of a mechanical interference fit. In accordance with a thirteenth non-limiting illustrative embodiment of this disclosure, the first, second, third, fourth, fifth, sixth, seventh, eighth, ninth, tenth, eleventh and twelfth non-limiting embodiments are further modified so that the connecting tube is laser marked with information relating to the manufacturing of the garment. In accordance with a fourteenth non-limiting embodiment of this disclosure, the first, second, third, fourth, fifth, sixth, seventh, eighth, ninth, tenth, eleventh, twelfth and thirteenth non-limiting embodiments are further modified so that the tube length is such that the fluid connector is disposed sufficiently to be located outside the perimeter of the inflatable chamber. In accordance with a fifteenth non-limiting illustrative embodiment of this disclosure, the first, second, third, fourth, fifth, sixth, seventh, eighth, ninth, tenth, eleventh, twelfth, thirteenth and fourteenth non-limiting embodiments are further modified so that the tube length is such that the fluid connector is disposed sufficiently to be located outside the perimeter of the garment. In accordance with a sixteenth non-limiting illustrative embodiment of this disclosure, the first, second, third, fourth, fifth, sixth, seventh, eighth, ninth, tenth, eleventh, twelfth, thirteenth, fourteenth and fifteenth non-limiting embodiments are further modified so that the distance between connector and inflatable chamber is such that the fluid connector is disposed within the perimeter of the inflatable chamber. In accordance with a seventeenth non-limiting embodiment of this disclosure, the first, second, third, fourth, fifth, sixth, seventh, eighth, ninth, tenth, eleventh, twelfth, thirteenth, fourteenth, fifteenth and sixteenth non-limiting embodiments are further modified so that the distance between connector and inflatable chamber is such that the fluid connector is disposed within the perimeter of the garment.

In accordance with an eighteenth non-limiting illustrative embodiment of this disclosure, the first, second, third, fourth, fifth, sixth, seventh, eighth, ninth, tenth, eleventh, twelfth, thirteenth, fourteenth, fifteenth, sixteenth and seventeenth non-limiting embodiments are further modified so that the barrel of the fluid connector is made of a brass material. In accordance with a nineteenth non-limiting illustrative embodiment of this disclosure, the first, second, third, fourth, fifth, sixth, seventh, eighth, ninth, tenth, eleventh, twelfth, thirteenth, fourteenth, fifteenth, sixteenth, seventeenth and eighteenth non-limiting embodiments are further modified so that the barrel of the fluid connector is made of a ferromagnetic material.

In accordance with a twentieth non-limiting illustrative embodiment of this disclosure, an inflatable garment is provided that comprises (a) an inflatable chamber, (b) a fluid connector, wherein the fluid connector has a circular elongated barrel, and wherein the barrel encompasses a ferrite component, wherein the ferrite component has a generally cylindrical shape consisting of a length, an outer diameter and an internal diameter, and wherein the length is greater than 4 mm. In accordance with a twenty-first non-limiting illustrative embodiment of this disclosure, an inflatable garment is provided that comprises (a) an inflatable chamber, (b) a fluid connector, wherein the fluid connector has a circular and elongated barrel, wherein the barrel includes a ferrite component, wherein the ferrite component has a generally toroidal shape consisting of an longitudinal length, an outer diameter and an internal diameter, wherein the generally toroidal shape has a longitudinal length greater than 4 mm.

In accordance with a twenty-second non-limiting illustrative embodiment of this disclosure, the first, second, third, fourth, fifth, sixth, seventh, eighth, ninth, tenth, eleventh, twelfth, thirteenth, fourteenth, fifteenth, sixteenth, seventeenth, eighteenth, nineteenth, twentieth and twenty-first non-limiting embodiments are further modified so that the ferrite component is contained wholly within the elongate fluid connector barrel. In accordance with a twenty-third non-limiting embodiment of this disclosure, the first, second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first and twenty-second non-limiting embodiments are further modified so that the ferrite component is flush to the extent of the elongate barrel.

In accordance with a twenty-fourth non-limiting illustrative embodiment of this disclosure, the first, second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first, twenty-second and twenty-third non-limiting embodiments are further modified so that the connector barrel includes internally mounting ribs for compressively mounting a component within the barrel. In accordance with a twenty-fifth non-limiting illustrative embodiment of this disclosure, the first, second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first, twenty-second, twenty-third and twenty-fourth non-limiting embodiments are further modified so that the internal compressible ribs are present on the internal walls of the connector barrel for substantially the length of the connector barrel. In accordance with a twenty-sixth non-limiting illustrative embodiment of this disclosure, the first, second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first, twenty-second, twenty-third, twenty-fourth and twenty-fifth non-limiting embodiments are further modified so that the garment has a fluid connector with a barrel, the fluid connector barrel has internal compressible ribs intended to semi-permanently retain a component within the barrel such that the component can be both retentive in operational use but not permanently fitted and therefore easily removable for recycling purposes.

In accordance with a twenty-seventh non-limiting illustrative embodiment of this disclosure, an extension device is provided, which is intended to provide a fluid connection from a fluid pump to an inflatable garment, wherein the extension device is able to be selectively connected or disconnected, and the extension device includes a first device connector and a second device connector, wherein the extension device has a fluidic connection between the first and second device connectors, and the first device connector has an identification component, wherein the identification component has a longitudinal length and is detectable by the pump such that air is provided into the extension device in response to the presence of the identification device. In accordance with a twenty-eighth non-limiting illustrative embodiment of this disclosure, the twenty-seventh embodiment is modified so that the identification component is made from a ferrite material.

In accordance with a twenty-ninth non-limiting illustrative embodiment of this disclosure, the twenty-eighth non-limiting embodiment is further modified so that the ferrite component has a longitudinal length of greater than 3 mm. In accordance with a thirtieth non-limiting illustrative embodiment of this disclosure, the twenty-ninth non-limiting embodiment is modified so that the ferrite component has a longitudinal length of greater than 5 mm. In accordance with a thirty-first non-limiting illustrative embodiment of this disclosure, the twenty-eighth non-limiting embodiment is further modified so that the ferrite component has a longitudinal length of greater than 8 mm. In accordance with a thirty-second non-limiting illustrative embodiment of this disclosure, the twenty-eighth non-limiting embodiment is further modified so that the ferrite component has a longitudinal length of greater than 11 mm. In accordance with a thirty-third non-limiting illustrative embodiment of this disclosure, the twenty-eighth non-limiting embodiment is further modified so that the ferrite component has a longitudinal length of less than 13 mm. In accordance with a thirty-fourth non-limiting illustrative embodiment of this disclosure, the twenty-eighth non-limiting embodiment is further modified so that the ferrite component is located solely within the barrel of the first device connector.

In accordance with a thirty-fifth non-limiting illustrative embodiment of this disclosure, the twenty-seventh non-limiting embodiment is further modified so that the identification component is made from a brass material. In accordance with a thirty-sixth non-limiting illustrative embodiment of this disclosure, the thirty-fifth non-limiting embodiment is further modified so that the length of the brass identification device is <6 mm. In accordance with a thirty-seventh non-limiting illustrative embodiment of this disclosure, the thirty-fifth non-limiting embodiment is further modified so that the length of the brass identification device is >6 mm. In accordance with a thirty-eighth non-limiting illustrative embodiment of this disclosure, the thirty-fifth non-limiting embodiment is further modified so that the brass component is located solely within the barrel of the first device connector.

In accordance with a thirty-ninth non-limiting illustrative embodiment of this disclosure, the twenty-seventh non-limiting embodiment is further modified so that the extension device includes flexible tubing located between first and second tube connectors. In accordance with a fortieth non-limiting illustrative embodiment of this disclosure, the twenty-seventh non-limiting embodiment is further modified so that the first and second tube connectors are connected rigidly together.

In accordance with a forty-first non-limiting illustrative embodiment of this disclosure, an inflatable garment is provided, which comprises at least one inflatable chamber, intended for connection to a pump, wherein the garment has a fluid connector for the inflation of the garment, and the garment connector has an elongate barrel made from ferrite. In accordance with a forty-second non-limiting illustrative embodiment of this disclosure, an inflatable garment is provided, which comprises at least one inflatable chamber, intended for connection to a pump, wherein the garment has a fluid connector for the inflation of the garment, and the garment connector has an elongate barrel made from brass.

In accordance with a forty-third non-limiting illustrative embodiment of this disclosure, the thirty-ninth non-limiting embodiment is further modified so that it is provided with tubing having a color. In accordance with a forty-fourth non-limiting illustrative embodiment of this disclosure, each of the non-limiting embodiments from the first to the forty-third may be further modified so that the connector color is configured to match the color of a compatible pump. In accordance with a forty-fourth non-limiting illustrative embodiment of this disclosure, each of the non-limiting embodiments from the first to the forty-third may be further modified so that the connector color is configured to match the color of a compatible pump. In accordance with a forty-fifth non-limiting illustrative embodiment of this disclosure, each of the non-limiting embodiments from the first to the forty-fourth may be further modified so that the color of the connector is at least partially transparent.

In accordance with a forty-sixth non-limiting illustrative embodiment of this disclosure, a pair of fluidic connectors is provided, wherein each connector is in fluidic connection with an inflatable garment, and the two garments are supplied as a pair of garments, where the color of each of the fluidic connectors is different. In accordance with a forty-seventh non-limiting illustrative embodiment of this disclosure, each of the non-limiting embodiments from the first to the forty-sixth may be further modified so that the inflatable garment is provided with tubing in fluidic connection with the inflatable chamber, wherein the tubing has a color.

In accordance with a forty-eighth non-limiting illustrative embodiment of this disclosure, each of the non-limiting embodiments from the first to the forty-seventh may be further modified so that the inflatable garment is provided with a visible external marking containing a '1' character. In accordance with a forty-ninth non-limiting illustrative embodiment of this disclosure, each of the non-limiting embodiments from the first to the forty-eighth may be further modified so that the inflatable garment is provided with a visible external marking containing a '2' character. In accordance with a fiftieth non-limiting illustrative embodiment of this disclosure, each of the non-limiting embodiments from the first to the forty-ninth may be further modified so that the inflatable garment is provided with a visible external marking containing an 'L' character. In accordance with a fifty-first non-limiting illustrative embodiment of this disclosure, each of the non-limiting embodiments from the first to the fiftieth may be further modified so that the inflatable garment is provided with a component visibly marked with an 'R' character.

In accordance with a fifty-second non-limiting illustrative embodiment of this disclosure, each of the non-limiting embodiments from the first to the fifty-first may be further modified so that the fluidic connector includes at least two physically separated fluid paths. In this context, the phrase "physically separated fluid paths" is intended to cover both multiple independent air paths and multiple air paths with a common pressure.

In accordance with a fifty-third non-limiting illustrative embodiment of this disclosure, each of the non-limiting embodiments from the first to the fifty-second may be further modified so that the inflatable garment includes a means of adding additional secondary marking to the garment components through the use of a secondary marking component. In accordance with a fifty-fourth non-limiting illustrative embodiment of this disclosure, the fifty-third non-limiting embodiment is further modified so that the secondary marking component is affixed to the garment. In accordance with a fifty-fifth non-limiting illustrative embodiment of this disclosure, the fifty-third non-limiting embodiment is further modified so that the secondary marking component is capable of attachment to the garment after initial manufacturing has been completed. In accordance with a fifty-sixth non-limiting illustrative embodiment of this disclosure, the fifty-third non-limiting embodiment is further modified so that the secondary marking is affixed to the tubing attached to the inflatable garment. In accordance with a fifty-seventh non-limiting illustrative embodiment of the disclosure, the fifty-third non-limiting embodiment is further modified so that the secondary marking component is affixed to the fluid connector on the garment. In accordance with a fifty-eighth non-limiting illustrative embodiment of this disclosure, the fifty-third non-limiting embodiment is modified so that the secondary marking component includes information related to the size of garment.

In accordance with a fifty-ninth non-limiting illustrative embodiment of this disclosure, each of the non-limiting embodiments from the first to the fifty-eighth may be further modified so that the inflatable garment includes a means of indicating the status of the garment in terms of its cleanliness. In accordance with a sixtieth non-limiting illustrative embodiment of this disclosure, each of the non-limiting embodiments from the first to the fifty-ninth may be further modified so that the inflatable garment includes a means of indicating the status of the garment in terms of its sterility.

BRIEF DESCRIPTION OF THE DRAWINGS

Embodiments of the present invention are described below, by way of example only, with reference to the accompanying drawings, in which:

FIG. 2 is a garment allocation table that is derived from FIG. 1.

FIG. 3 is a pump compatibility table that is derived from FIG. 1.

DESCRIPTION OF ILLUSTRATIVE EMBODIMENTS OF THIS DISCLOSURE

Figure 1:
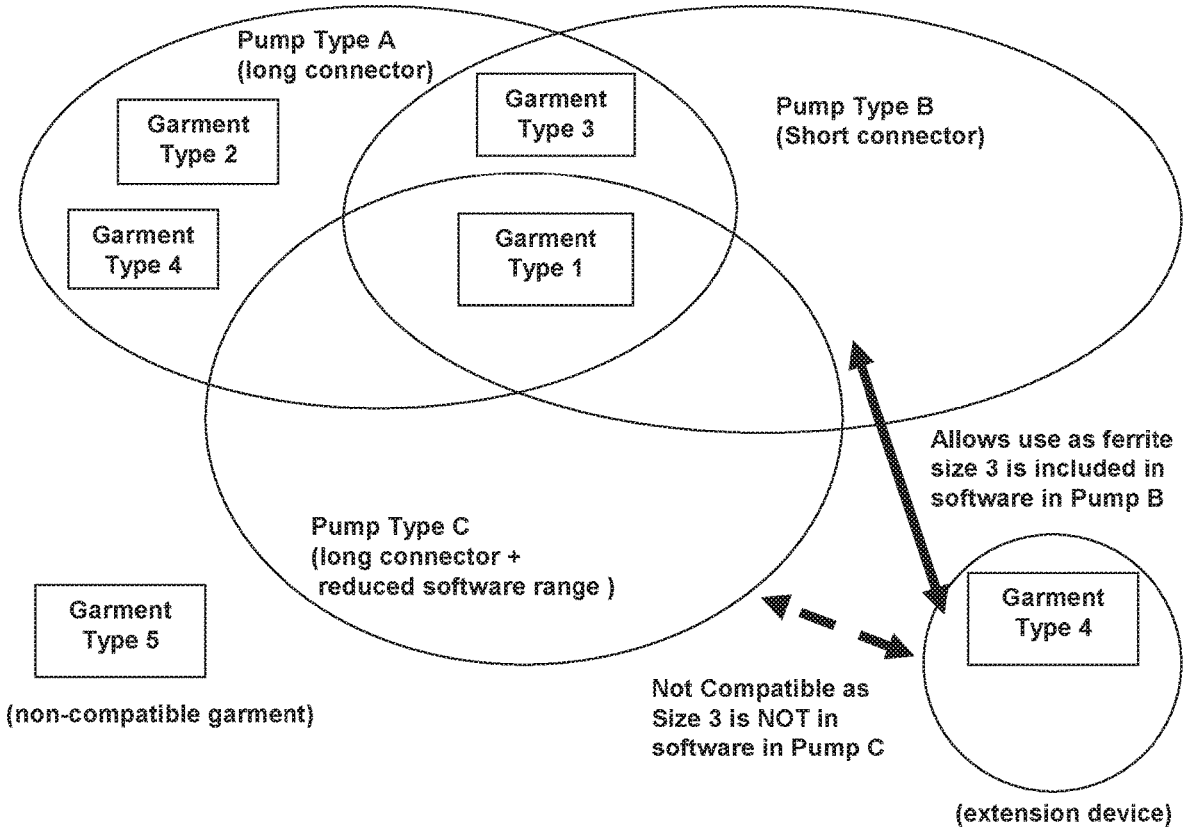
FIG. 1 is a compatibility diagram that shows an example of the compatibility achieved by one or more embodiments of this disclosure.

With respect to FIGS. 1, 2 and 3, consider the compatibility situation with 5 different garment types, such as garment types 1-5, 5 different ferrite types (short, long and intermediate sizes named size 1, 2, 3) and two different garment connectors (short and long barrel). In addition, an extension device, as per an embodiment of this disclosure, is included that has a short barrel connector with a size 3 ferrite.

The two connectors allow differing sizes of ferrites to be fitted, for example, the short garment connector only allows the ferrites defined as short, size 1 and size 3 to be fitted, whereas the longer connector allows all sizes of ferrite to be fitted. The relationship defining which garment is associated with which ferrite and which connector is first compiled in the garment allocation Table of FIG. 2. The pump compatibility table of FIG. 3 takes this information and further includes software compatibility considerations, i.e., which garment is allowed to be used with which pump.

Figure 8A:
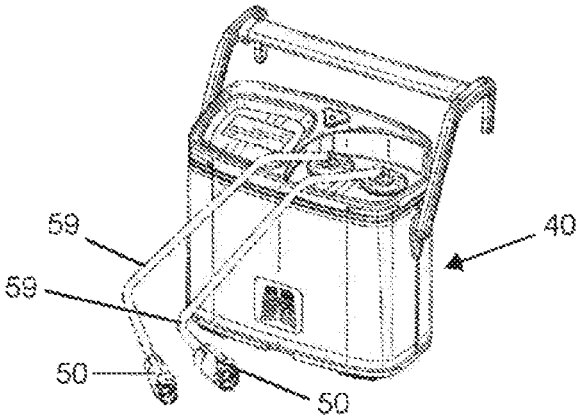
FIGS. 8*a*, 8*b*, 8*c*, 8*d* and 8*e* show images of various pumps and connectors, as used in an exemplary embodiment of this disclosure.
Figure 8B:
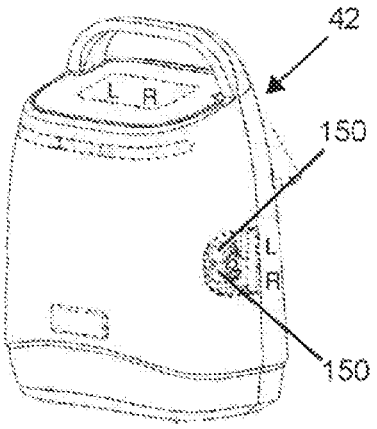
Figure 8C:
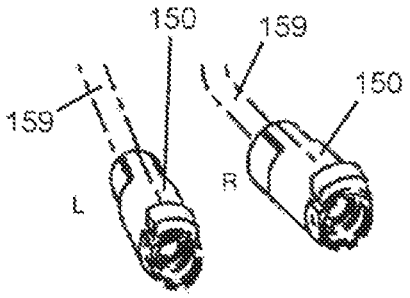
Figure 8D:
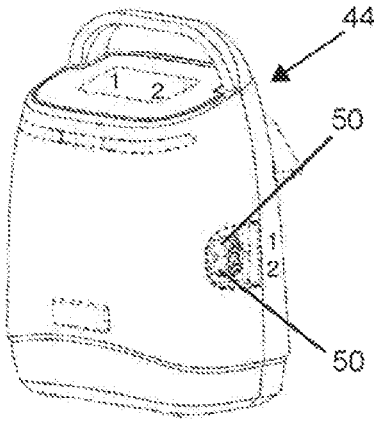
Figure 8E:
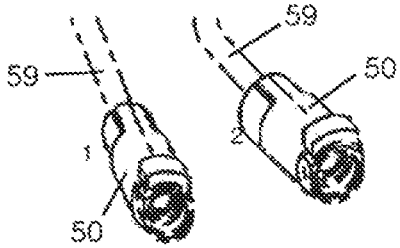
Figure 9A:
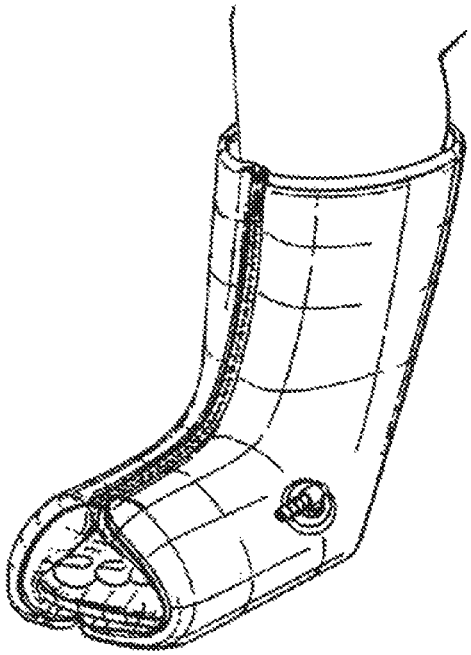
FIG. 9a PRIOR ART
FIGS. 9*a* and 9*b* illustrate examples of differing garments from the prior art utilizing a single connection tube and, therefore, the benefit of being able to differentiate between them and manage compatibility.
Figure 9B:
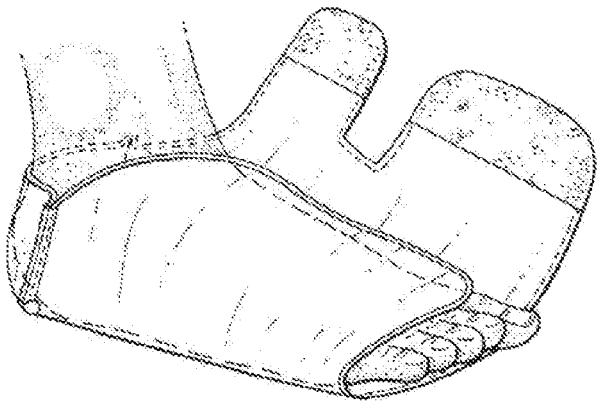
FIG. 9b PRIOR ART

Using one or more embodiments of this disclosure, the resulting compatibility situation is therefore derived from the following description. An embodiment of the present disclosure is arranged so as to operate in the following manner:

Pump type A (FIG. 8*a*) has a universal connector that is able to mechanically receive and operate with a range of garment connectors (i.e. long and short barrels), so it can detect a wide range of component sizes and has the necessary software to support a wide range of garments. Thus, the universal connectors 50 of a type A pump 40 make its connectivity compatible with many different inflatable garments due to connection compatibility with both short and long garment connectors 16, 116, and its software 82 allow it to identify and operate these many different inflatable garments. Therefore, for the purposes of this disclosure, pump type A 40 may also be characterized as a "pump of ubiquitous compatibility." Optionally, pump type A 40 may be provided with extension fluid tubing 59 connecting the universal connectors 50 to the pump.

pump type B (FIG. 8*b*) has a non-universal connector 150 that is able to only receive and operate with short barreled garment connectors 116 and, hence, supports a reduced range of garments compared to pump type A. pump type B 42 can be provided with an extension device 159 (as per an embodiment of the present disclosure employing extension fluid tubing). Because there are visual similarities between non-universal connectors 150 and universal connectors 50, as evident from FIGS. 8*c* and 8*e*, it is advantageous to use different colorings or markings (i.e., "1" and "2" versus "L" and "R") to make connection compatibility easier to understand and recognize.

Pump type C (FIG. 8*d*) is like pump type A in that it employs universal connectors 50 that are able to mechanically receive a wide range of garment connectors (i.e. long and short barrels), but pump type C is configured in software to only respond to a reduced number of component sizes and, hence, garment types. Optionally, pump type C 44 may be provided with extension fluid tubing 59 connecting the universal connectors 50 to the pump.

Garment type 1 is intended for use in all pumps of a given class (e.g. pump types A or B and C). Hence a shorter barrel is used on the connector on this garment to ensure maximum compatibility with both universal and non-universal connectors. Therefore, garment type 1 may be characterized, in accordance with this disclosure, as an "inflatable garment of ubiquitous compatibility."

Garment type 2 is intended only to be used on specific pumps (e.g., pump type A); hence, a longer barrel is used on the garment connector on this garment. This in it itself prevents access to type B pumps because longer barreled garment connector is not compatible with the non-universal connector of type B pumps.

Garment type 3 is intended for use in all pumps of a given class (e.g. pump types A, B and C) as long as the pump has the appropriate software. Hence, a shorter barrel is used on the garment connector on this garment to ensure maximum compatibility because it mechanically fits to both universal and non-universal connectors.

Garment 4 can be directly plugged into pump type A as it has the longer ferrite. However, it can also plug into an extension device and the extension device is itself recognized by pump type B (if this is pre-configured to include software support for this device). Hence, pump type B can recognize garment 4 via a proxy detection of the extension device and its own specific ferrite.

Hence garment 4 can be compatible with either pump type A or pump type B (but only via the specific extension device). Garment 4 is not compatible with pump type C because pump type C does not have either the mechanical means to receive the longer garment connector or the supporting software to recognize garment 4 as a compatible garment.

Thus, the extension device can be supplied selectively to allow this compatibility, which can be done after a product launch and on a limited basis as required. For example, to a specific customer who has pump type B and has a need for this garment, despite the pump and garment not being directly compatible, the extension device is used to provide this additional compatibility in a controlled manner as it is only when the extension device is present does the compatibility become effective.

Garment type 5 is not intended to be supported by any pump. It is a non-compatible garment from either a different product range or even a different manufacturer. It is shown in FIG. 1 as being non-compatible with all the pumps. However, the garment connector used may be physically compatible as it is a commercially available off the shelf item that can be easily mistaken by a user as being compatible. However, the lack of the identification component, or the associated coloring and marking, means that the garment is not used as a compatible product and the user receives clear feedback of this lack of compatibility.

It should be evident to a person skilled in the art that embodiments of this disclosure could be used to create a further extension device to address the lack of compatibility with garment 5. This further extension device would have a second connector specific to the mechanics of the connector used on garment 5 and provided with a further identification component present in the first connector. It could include marking, coloring and visual aspects associated with garment 5. With the inclusion of support for this further identification component in the appropriate pump software, then garment 5 could then be made compatible with the pump(s), such as pump type A and/or pump type B and/or pump type C.

The Venn diagram in FIG. 1 shows the compatibility as a result of one or more embodiments of this disclosure. As can be seen from the example tables in FIGS. 2 and 3, embodiments of this disclosure allow various decisions to be made on compatibility of various garments with various pumps.

Figure 10A:
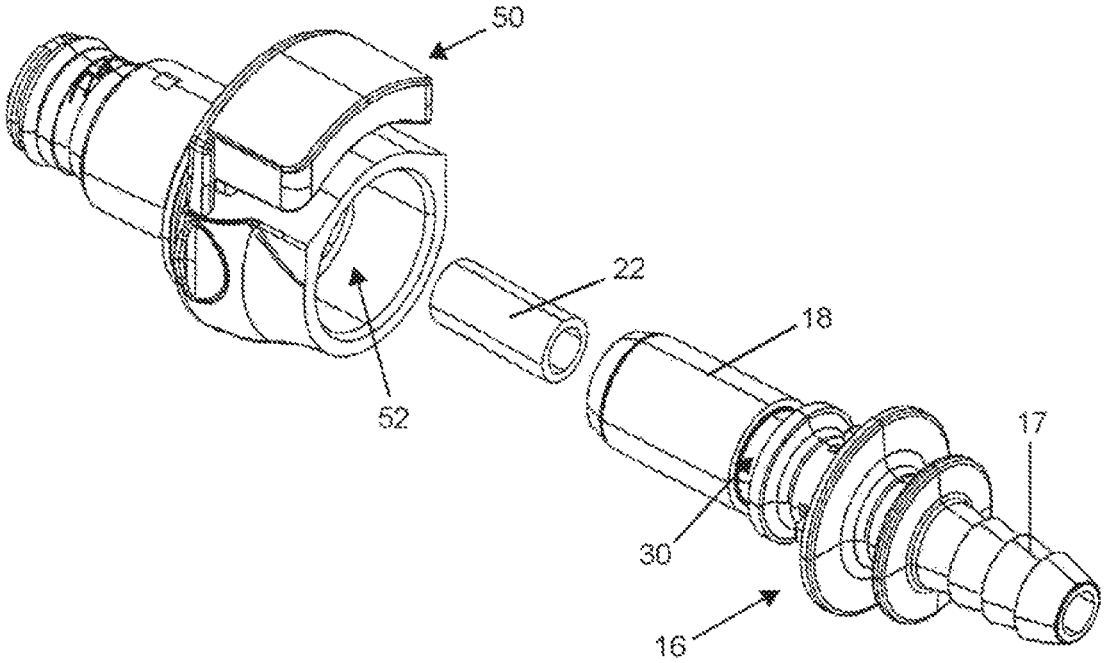
FIGS. 10*a* and 10*b* illustrate exploded views of connector and ferrites, which shows the long and short barreled connectors in accordance with an embodiment of this disclosure and an embodiment of the prior art, respectively, and associated barrel mounted components such as the longer ferrite.
Figure 10B:
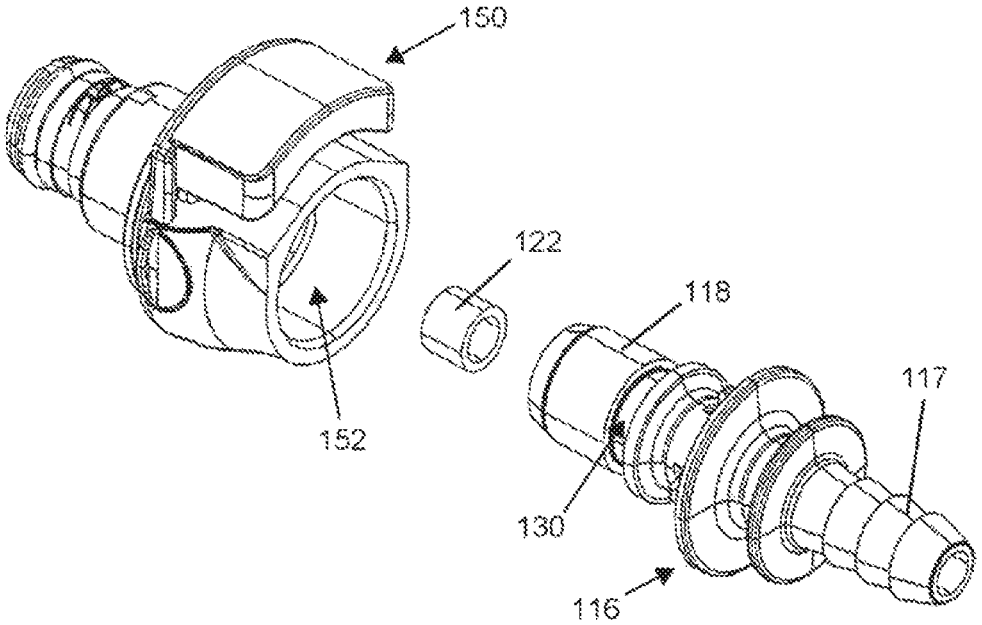
FIG. 10b PRIOR ART
Figure 11A:
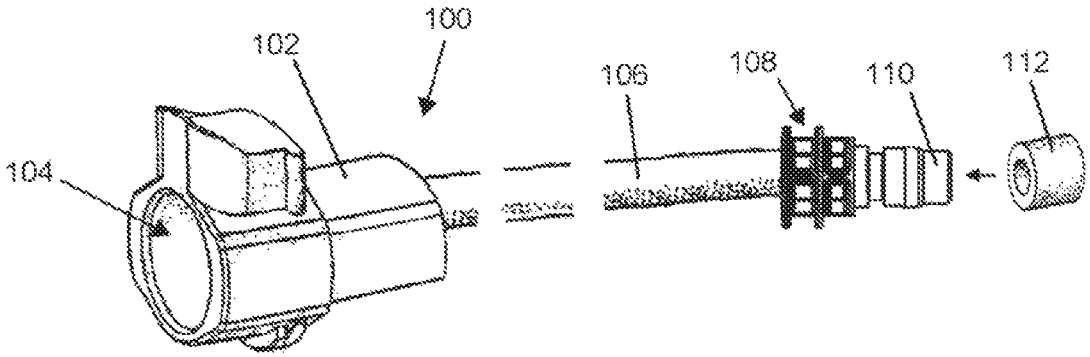
FIGS. 11*a* and 11*b* show an extension device in accordance with an embodiment of this disclosure so as to illustrate operation and construction of the extension device.
Figure 11B:
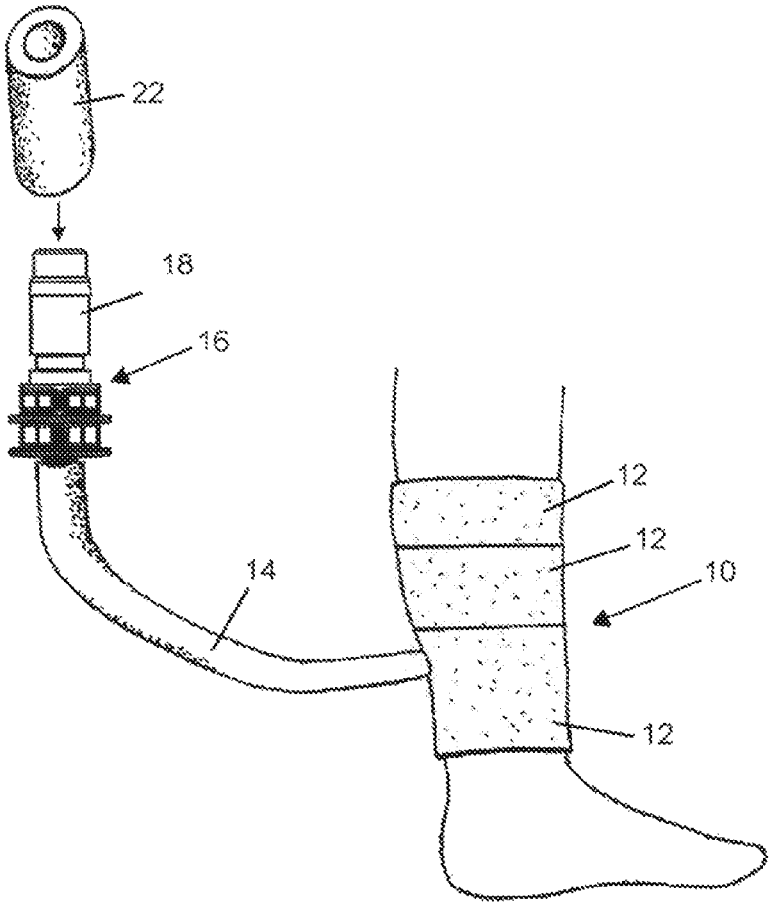

As shown in FIG. 11*b*, an inflatable garment 10, which may include one or more inflatable chambers 12, may also include a connecting fluid tube 14, and a garment fluid connector 16 in fluidic connection with the one or more inflatable chambers 12. The garment fluid connector 16 has a connector barrel 18, which may be circular, substantially circular, or mostly circular, or some other suitable shape. The barrel 18 has a length and an outside diameter as evident from FIG. 11*b*. An identification component 22 may be disposed inside the barrel 18 because the barrel 18 is hollow, so the identification component 22 is insertable into the interior of the hollow barrel 18. Thus, barrel 18 also includes an inside diameter. The length of barrel 18 is elongated so that it is substantially longer than the length of a barrel 118 of a conventional garment fluid connector 116 as evident from comparing FIGS. 10*a* and 10*b*. The barrel 18 is configured so it allows the garment fluid connector 16 to form a fluidic connection with a mating-type connector 50 when the barrel 18 is inserted inside a cavity 52 formed in the mating-type connector 50, as evident from FIG. 10*a*. The barrel 18 and the cavity 52 are each configured so that they form a reversible engineering fit, such as a sliding fit although other fits may be used, when connected together and so that a continuous fluid path for inflation is formed through this connection joint between the garment fluid connector 16 and the mating-type connector 50.

Figure 13:
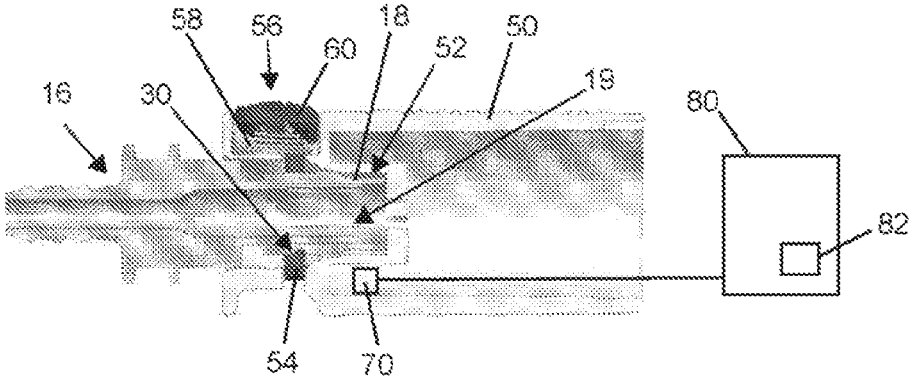
FIG. 13 is a schematic cross-sectional view illustrating a connection between a garment fluid connector and a mating-type connector in accordance with an embodiment of this disclosure.

Cavity 52 has a depth that is sufficient to accommodate sufficient insertion of the barrel 18 into the cavity 52, as shown in FIG. 13, so that a latch 54 of a latch assembly 56 of the mating-type connector 50 can engage a groove 30 formed in, or at one end of, the barrel 18. The latch 54 is biased by a spring 58 against the groove 30 so as to secure the barrel 18 in cavity 52. Pressure applied to a pin 60 of the latch assembly 56 can compress the spring 58 and move the latch 54 out of groove 30 so that the barrel 18 may be readily removed from the cavity 52.

On the other hand, a conventional mating-type connector 150, such as shown in FIG. 10*b*, has a cavity 152 that has substantially the same internal diameter as the cavity 52. However, the depth of cavity 152 is not sufficient to properly accommodate barrel 18 of the garment fluid connector 16. Consequently, while barrel 18 of the garment fluid connector 16 may be partially inserted into the cavity 152 of mating-type connector 150, it cannot be securely latched into cavity 152 by a latching assembly because the groove 30 will not properly align with the latch of the latching assembly of the mating-type connector 150.

The barrel 118 of the conventional garment fluid connector 116 is dimensioned to fit inside the cavity 152 of the conventional mating-type connector 150 so that the groove 130 of the garment fluid connector 116 properly engages a latch of a latching assembly in order to secure the connection between the garment fluid connector 116 and the mating-type connector 150. Because barrel 118 is shorter than barrel 18, and because they have substantially similar outside diameters, the barrel 118 may be inserted into cavity 52 of the mating-type connector 50 so that its groove 130 also may be engaged by latch 54 of the latching assembly 60 in order to secure the connection between garment fluid connector 116 and the mating-type connector 50 in the same manner as it can secure the connection between the garment fluid connector 16 and the mating-type connector 50.

In other words, both the garment fluid connector 16 and the garment fluid connector 116 may securely connect to the mating-type connector 50. However, while the garment fluid connector 116 may securely connect to the mating-type connector 150, the garment fluid connector 16 cannot because its barrel 18 is too long, therefore making it incompatible with the dimensions of cavity 152. From another perspective, because cavity 52 is deeper than cavity 152, the mating-type connector 50 can accommodate both garment fluid connectors 16, 116 whereas the mating-type connector 150 can only accommodate garment fluid connector 116. Thus, in accordance with this disclosure, mating-type fluid connector 50 may be characterized as a universal connector whereas the mating-type fluid connector 150 may be characterized as a non-universal connector.

Figure 7A:
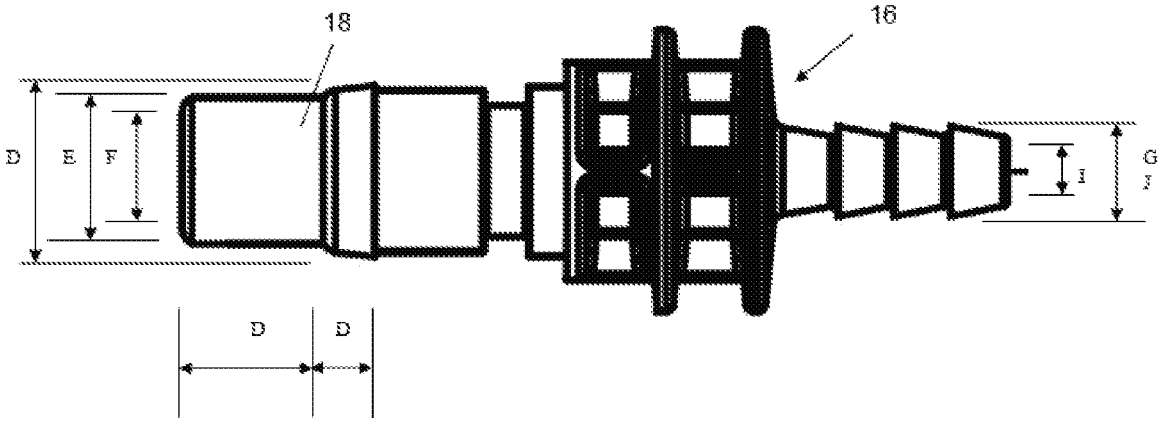
FIGS. 7*a* and 7*b* illustrate example relationships of connector parameters in accordance with an embodiment of this disclosure and a prior art device, respectively.
Figure 7B:
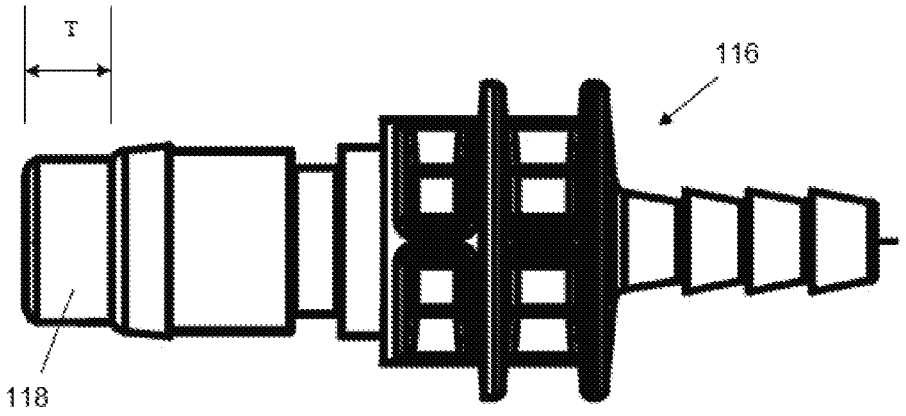
FIG. 7b PRIOR ART

As shown in FIGS. 10*a* and 10*b*, garment fluidic connectors 16 and 116 are provided with a barbed portion 17 and 117, respectively, which is used to mount garment tubing 14 thereon via an interference fit, for example. FIGS. 7*a* and 7*b* further illustrate substantial different configurations between garment fluidic connector 16 and garment fluidic connector 116.

It should be apparent that although this situation is already complex with the relatively small number of garments, it can become even more complex as the number of garments and pumps increases. Hence, the benefit of the embodiments of this disclosure is clear as it allows an effective tool to manage this complexity.

It is known to use a component to interact with an electronic sensing circuit to provide an automatic identification of the connected garment, particularly where the component is made from a ferrite or brass material. See, e.g., U.S. Pat. No. 6,884,255 B1, which is incorporated herein by reference for all it discloses. The use of ferrite in the component is usually manufactured by a compression or sintering process from an iron powder.

In accordance with an embodiment of this disclosure, the identification component 22 is disposed within the barrel 18 in order to provide its identification via a radio-frequency identification (RFID) mechanism when in close proximity to an appropriate RFID sensor 70. The RFID sensor is operably connected to send a signal to a processor 80 associated with a garment inflation pump, such as pump type A or pump type C, which is provided with software 82 to process the signal so as to identify the identification component 22 based on a magnetic property of the barrel 18, such as impedance.

These types of components are conveniently manufactured in large quantities in cylindrical and toroidal forms for use in many electronic applications including the control of electrical noise in electromagnetic compatibility (EMC) related applications. This style of component is ideal for mounting within the connector barrel as it combines the advantages of a thin material wall section and a large internal central path suitable for the passage of air (i.e., suitable for use as a fluid path) that was originally intended for an electrical cable. The manufacturing process, and typically toroidal shape, readily lend this type of component to assembly within the connector using compression ribs.

Figure 6:
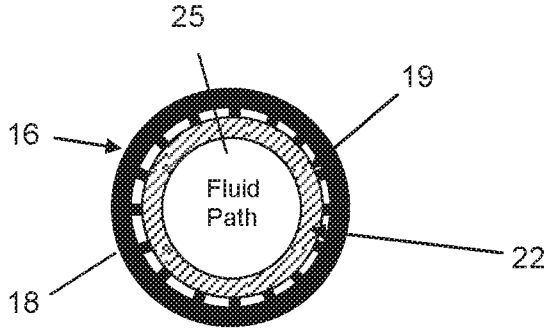
FIG. 6 is a cross section of a connector barrel showing ribs and identification component in accordance with an embodiment of this disclosure.

Thus, in accordance with an embodiment of this disclosure, as shown in FIG. 6, the connector barrel 18 of the garment fluid connector 16 may be provided with compression ribs 19 that are used to secure the identification component 22 inside the barrel 18 via a press fit or other interference fit. In this way, the identification component 22 may be securely fixed inside the barrel 18 without the use of an adhesive. In accordance with an embodiment of this disclosure, the ribs 19 are located circumferentially along the interior surface of the barrel 18, with a rib 19 located about every 20-30 degrees. The identification component 22 may be a ferrite cylinder. When the identification component 22 is mounted within the barrel 18, the ferrite material is in contact with the ribs 19 rather than the entire interior surface of the barrel 18. This structure provides a degree of protection for the ferrite material as well as contributes to the ease of insertion of the identification component 22, which is secured within the barrel 18 with a circumferential interference fit from the compressible ribs 19.

In accordance with an embodiment of this disclosure, the ribs 19 are in contact with approximately 30% of the circumferential area of the surface of the ferrite component 22. In this context, the range of approximately 30% encompasses contact areas that provide a suitable interference fit with the ribs 19. The ribs 19 provide the interference fit to the ferrite component 22 to the connector barrel 18, so the identification component is located along the center of the barrel 18. The spacing between the outer diameter of the ferrite component 22 and the internal surface of the barrel 18 is intentionally only minimal to provide clearance and, hence, ease of insertion.

Figure 5A:
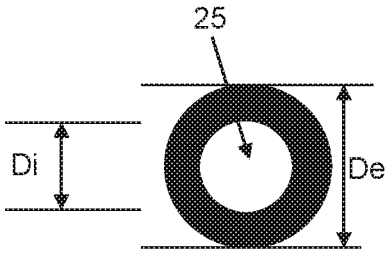
FIGS. 5*a*, 5*b*, 5*c*, 5*d*, 5*e* and 5*f* illustrate an identification feature of component devices, in accordance with one or more embodiments of this disclosure.
Figure 5B:
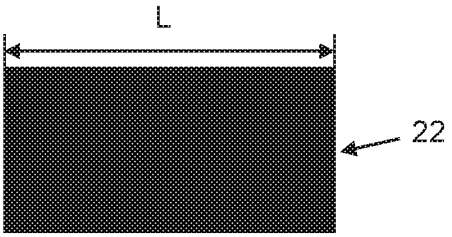

As shown in FIGS. 5*a* and 5*b*, in accordance with an embodiment of this disclosure, the identification component 22 is a hollow cylindrical tube having an external diameter De and an internal diameter Di, with a wall that defines a fluid passage or path 25. The internal component 22 is elongated, having a length L that is substantially the same as the length of barrel 18, or only slightly smaller so that the identification component 22 fits substantially inside the barrel 18. In the example of FIGS. 5*a* and 5*b*, the external diameter De may be 7.8 mm, the internal diameter Di may be 5.3 mm, and the length L of the identification component 22 may be 12 mm. In the embodiment of FIGS. 5*a* and 5*b*, the identification component 22 may be a ferrite component that has orthogonal edges, and the fluid path 25 may be off-center from the central axis of the identification component 22. Thus, the wall of the identification component 22 does not have to have a uniform thickness.

Figure 5C:
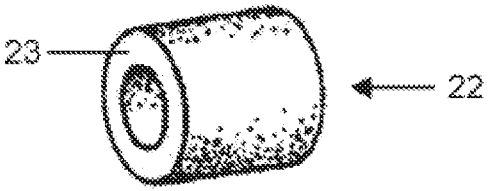

FIG. 5*c* shows another embodiment of the identification component 22 in accordance with this disclosure. The identification component 22 of FIG. 5*c* is made of a ferrite based material or a brass based material, with a fluid path located centrally with in the cylindrical tube and along its central axis. The thickness of the wall 23 of the identification component 22 is on the order of about 1.25 mm, and the ratio of external diameter 7.8 mm to internal diameter 5.3 mm is 1.4. The ratio of external diameter to length is substantially greater than it is for identification component 122 of FIG. 10*b* so the impedance of the identification component 22 will be substantially different from the impedance of the identification component 122.

Figure 5D:
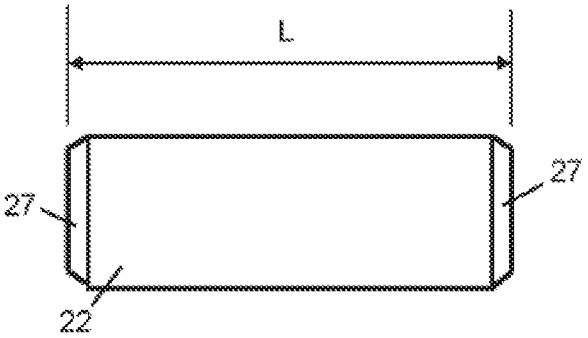

FIG. 5*d* illustrates an embodiment of the identification component 22 in which the identification component is cylindrical with a chamfer 27 on its edges in order to ease insertion into the connector barrel 18. This chamfer structure also helps to deform the internal ribs 19.

Figure 5E:
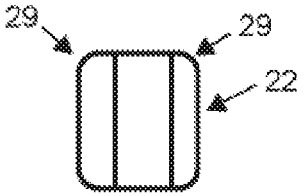

FIG. 5*e* illustrates an embodiment of the identification component 22 that is made of ferrite material or brass material, and formed generally in the shape of a toroid. The rounded edges 29 of the toroid provides for easier insertion of such an identification component into the connector barrel 18, and help to deform the internal ribs 19.

Figure 5F:
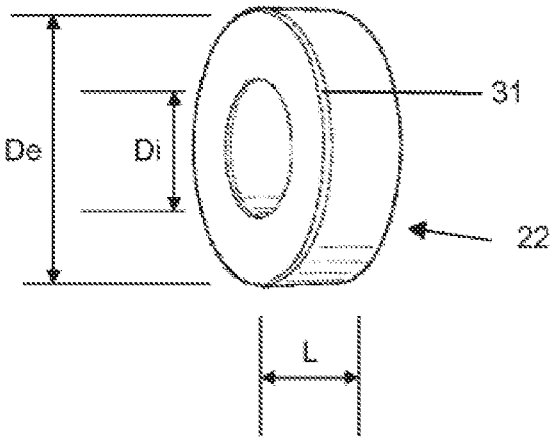

FIG. 5*f* illustrates another embodiment of the identification component 22 that is made of ferrite material or brass material, and formed generally in the shape of a toroid. The toroid has an external diameter De, and internal diameter Di, and a length L, which are dimensioned so that the impedance of the identification component 22 is substantially different from the impedance of the identification component 122. In this embodiment, the identification component 22 has edges 31 that are chamfered or rounded, and the length L is smaller than the external diameter De.

The advantage of the use of a toroid ferrite is that the proximal and distal edges are rounded, hence, there is less chance of the identification component 22 shearing the compressible ribs 19 before they can deform on the periphery of the component and provide the compression necessary to achieve the interference fit within the component barrel 18. If the component 22 is formed from a ferrite tube, then the edges may be chamfered to avoid the shearing of the compression ribs during its insertion into the connector barrel.

It is now possible to obtain ferrite doped plastic and, hence, a further aspect of the disclosure involves the use of the ferrite material to produce either the connector barrel 18 or the entire connector 16 and, hence, avoid the need for the internal ferrite component 22. This approach provides the same effect and benefits as using a ferrite component as described herein, hence, this embodiment also falls within the scope of this disclosure.

As an alternative to the use of ferrite, it is possible to use a copper alloy such as brass, typically an alpha-beta grade of brass. This is readily computer numerical control (CNC) machined into the necessary size available inside the connector 16. The use of brass has an opposite effect to the sensing method compared to ferrite, hence, it is readily distinguishable using the measurement circuit 70 and 80, and best used for a significantly different class of garments compared to those using the ferrite material. In other words, an identification component made of brass has substantially different magnetic properties (e.g., impedance) than an identification component made of ferrite material.

In order to allow for an advantageous assembly process of the brass component into the connector barrel, the brass component can optionally have a chamfer machined to its edges. This is beneficial because the brass is a much harder material than ferrite and, hence, is even more capable of shearing the compressible ribs 19 rather than deforming them as intended. This chamfering results in an improved mechanical engagement with the intended mounting compression ribs 19 present on the internal surface of the connector barrel 18. This embodiment provides the same effect and benefits as using a barrel mounted brass component as described, therefore it also falls within the scope of this disclosure.

Figures 4A, 4B, 4C, 4D:
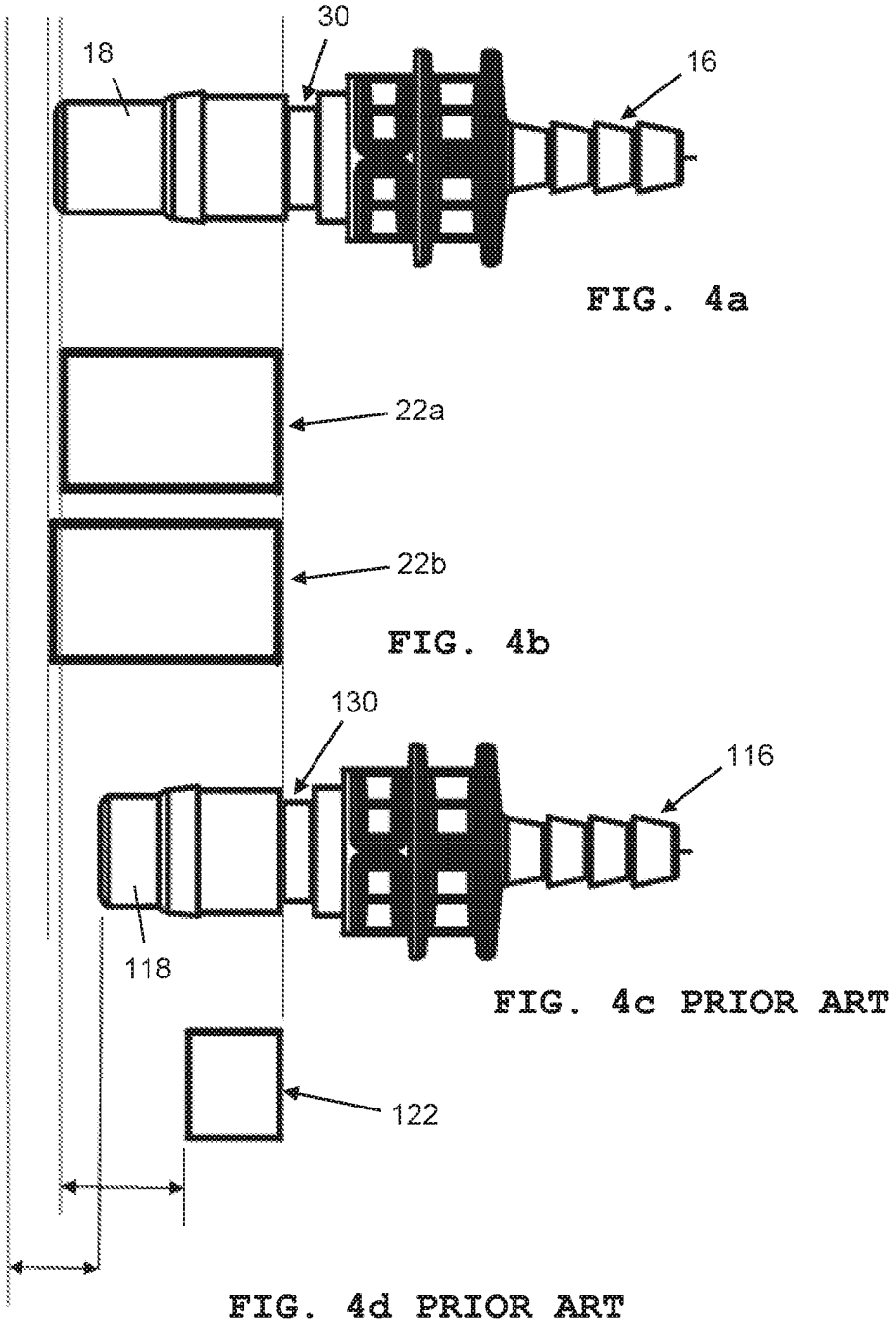
FIG. 4c PRIOR ART
FIG. 4d PRIOR ART
FIGS. 4*a* and 4*b*, and 4*c* and 4*d* illustrate connector lengths and ferrite sizes between an embodiment of this disclosure and a prior art fluidic connector.

FIGS. 4*a* and 4*b* illustrate an embodiment of a garment fluid connector 16 of this disclosure that is substantially different from a prior art garment fluid connector 116 in terms of its geometry and impedance, which means that it has a substantially different identification signal profile detectable by sensor 70 than the garment fluid connector 116. Garment fluid connectors 16 and 116 have the same barrel diameter; however, the length of barrel 18 is substantially greater that the length of barrel 118. In accordance with an embodiment evident from FIGS. 4*a* and 4*b*, the identification component 22*a* is 12 mm long and is disposed entirely within the longer fluidic connector 16 so as not to be distally flush with the distal end of the fluidic connector 16. In accordance an embodiment evident from FIGS. 4*a* and 4*b*, the identification component 22*b* is 13 mm long and is disposed entirely within the longer fluidic connector 16 so as to be distally flush with the distal end of the fluidic connector 16.

On the other hand, the prior art embodiment of FIGS. 4*c* and 4*d* employs an identification component 122 made of ferritic material and that has a length of less than 4 mm that is located entirely within the shorter barrel 118. Barrels 18 and 118 have the same outer diameter. However, the substantial difference in length results in a substantial difference in at least one magnetic property and a substantial shift in identification signal that can be detected by sensor 70.

The significant quantities of compression garments used worldwide and the nature of their typical single-patient clinical use means that there are important environmental and design considerations to be addressed. Advantageously, it is possible to avoid the use of adhesive by using the compression ribs 19 and still ensure the identification component 22 is retained in position within the barrel throughout the use of the garment. Furthermore, the use of the compression ribs 19 within the connector 16 means there is a further advantage during the end of use & recycling process. The identification component 22 is capable of being easily extracted from the barrel of the plastic connector using an appropriate tool and, therefore, the materials can be readily separated (e.g., metal from plastic) and sorted to allow for more effective re-use or recycling.

An embodiment of the present disclosure includes the use of a significantly longer identification component 22 within the barrel 18, and in order to ensure this is retained, additional design features are included in the structure of the connector 16. In order to effectively retain the longer component 22, compression ribs 19 are located along the length of the internal surface of the barrel 18. Thus, there is a mechanical interference fit present along the entire length of the component 22 in accordance with an embodiment of this disclosure.

The ease of insertion of the identification component 22 into the connector barrel 18 is a consideration due to the longer length, hence, it is necessary to increase the mechanical clearance between the outer diameter of the identification component 22 and the internal diameter of the connector barrel 18. Also, to ensure the leading edge of the component 22 deforms the compressible ribs 19 in a controlled and consistent manner during insertion, the use of a chamfer on at least the leading circumference is used. In one embodiment, both the component edges 27 are chamfered so that the connector can be inserted in either orientation. An alternative method of achieving the effect of the chamfer is to use a toroidal shape component.

The identification component 22 is intended to avoid leaks during use; hence, the various parts are dimensioned to ensure that there is a compressible aspect to the connector 16 when fitted to the mating connector 50. In order to avoid potential problems with inadvertent damage due to circumferential compression, and the resulting potential cracking of the ferrite component 22 during the insertion of the garment connector 16, the barrel 18 containing the component 22 can be compressible in order to ensure the use of a tight and hence non-leaking fit.

It is necessary to provide some compliance to the entire connector 16. This is achieved through the use of longer ribs 19 that are compressed when the identification component 22 is fitted, and hence the component 22 is only in direct contact and held in place in the circumferential areas of the barrel internal surface where the ribs 19 are present. There are typically ribs spaced around the circumference typically every 20-30 degrees, thus resulting in a large number of ribs. Each rib 19 is characterized with both a narrow width and a length such that the distance between diametrically located ribs is less than the outside diameter of the ferrite component 22 and, hence, it is able to be readily deformed. This forms a circumferential interference fit between the connector ribs 19 and the ferrite component 22. As a result of the deformation of the ribs 19 when the ferrite component 22 is inserted, there is a degree of compliance achieved between the barrel 18 of the connector 16 and the ferrite component 22.

An advantageous feature of the compressible ribs 19 is that they provide a means of holding the longer component 22 in place within the long connector barrel 18 when the garment is in use, whilst also allowing the removal of the component 22 as part of a subsequent disposal and recycling process.

This compliance is utilized through the use of an exemplary relationship between the outer barrel diameter, inner barrel diameter, number and detail of the compression ribs 19 on the inside of the barrel 18 and the outer diameter of the ferrite component 22.

A further aspect of this disclosure is that the features and aspects described above are all capable of being integrated into a small space, such as that found in smaller connectors that are typically used for inflatable garments. This involves a combination of the various items within a garment connector containing a single fluidic path. One exemplary embodiment thus includes a garment connector 16 whose external barrel is less than 15 mm in diameter as this is conveniently sized and considered typical for a product of this type.

In order to achieve a significant amount of fluid flow into the garment then, it is beneficial if as much space as possible within the connector 16 is available to form the fluid path 22. This involves ensuring that the impact of the cross section of the component 25 located in the barrel 18 is minimized. Thus, in accordance with this disclosure, one or more embodiments include key dimension metrics that define the characteristics of the connector features in order to ensure the fluid path 25 is optimized. These metrics cover the relationships of the following mechanical aspects of the connector 16.

The ratio of the various dimensions of the ferrite component 22 fitted into the connector barrel to provide garment detection form important aspects of the design. For example, the outer diameter to the inner diameter is a consideration as this defines the fluid path 25 into the garment. In one embodiment, the outer diameter is such that it is less than two (2) times that of the inner diameter. This ensures that there is a sufficiently large path to achieve the inflation of the garment whilst also ensuring that the material component has a wall thickness allowing a suitably robust construction.

Where a toroid-shaped ferrite component is used, these often have an improved mechanical strength due to their method of construction, hence, it is possible to achieve a reduced wall thickness. In one embodiment, it may be possible to achieve a ratio of outer diameter to inner diameter of less than 1.6. However, this disclosure should not be limited solely to its exemplary embodiments.

To avoid introducing any restriction, in one embodiment the fluid path 25 through the connector 16 has both as large an internal diameter area as possible and also is formed into a straight line through the connector 16 from distal to proximal face. One aspect of this involves the use of a relatively thin-wall section for the barrel garment connector, typically molded in a thermoplastic such as Polyethylene PE or Polyvinylchloride PVC, wherein this wall section is characterized such that the inner diameter of the barrel 18 is >70% of the outer diameter of the barrel 18. This aspect helps reduce the use of material in the connector 16 and also provides a more flexible barrel area to the connector 16, which in turn improves both the insertion and compliance characteristics.

In one embodiment, the internal diameter of the fluid path 25 through the garment connector 16 is larger than that present through the tubing 14 that is attached to the connector 16 and the inflatable chamber 12 of an inflatable garment 10.

Figure 12C:
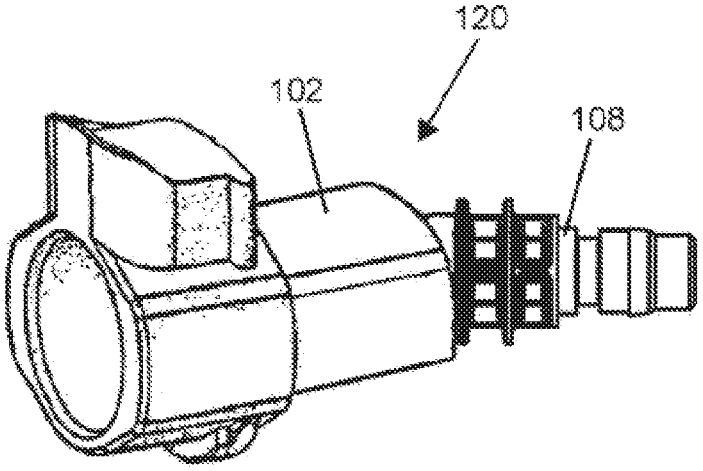
FIGS. 12*a*, 12*b* and 12*c* pertain to an extension device, illustrating example embodiments including a multi-path connector, a long connector, and a short rigid connector, respectively.
Figure 12A:
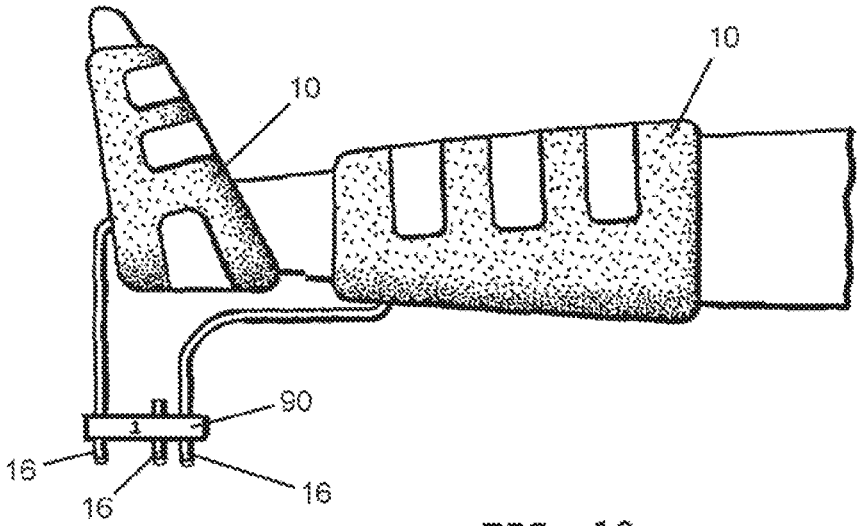

Another aspect that falls within the scope of one or more embodiments of this disclosure involves grouping together a number of the individual single connectors 16 in a multiple path connector 90 each with its own fluid path, as shown in FIG. 12*a*. Each individual connector can individually utilize any of the aspects described in this disclosure or alternatively an aspect can be shared by the combined connector. Such a multi-path connector 90, which is a garment fluid connector provided with multiple individual air paths and short garment tubing results in the multi-path connector 90 located proximate the perimeter of the garments 10.

The connector 16 and tubing 14 are typically assembled together as a sub-assembly, therefore it is beneficial to record suitable manufacturing information such as lot number and model number on the tubing itself. The joining of the garment connector 16 and the tubing 14 may be undertaken by means of a compression fit. This further allows the product to be easily disassembled as part of the recycling process.

Figure 12B:
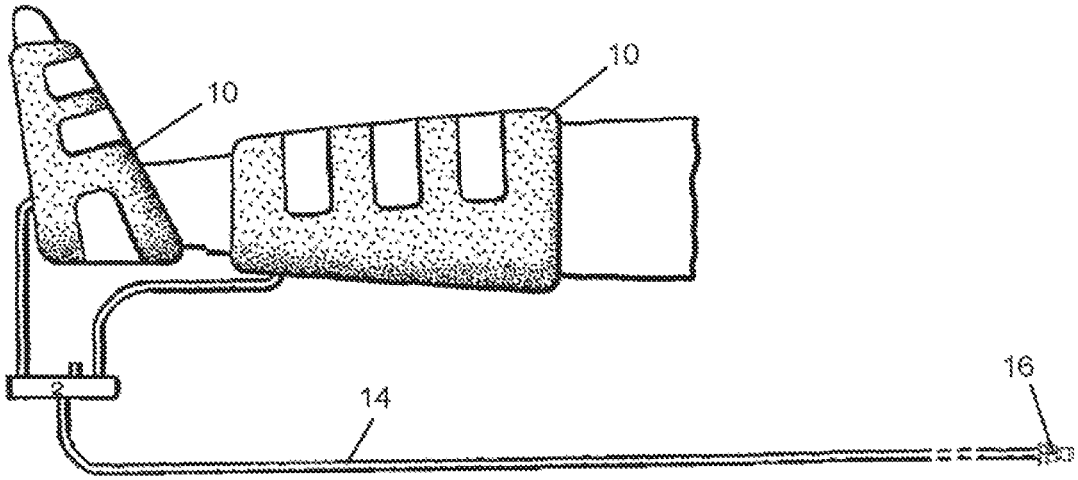

The elongation of the connector barrel 18 results in a physically larger connector 16 compared to other connectors 116. It may be useful to ensure that this does not create a potential to be a hazard to the patient's limb, for example, by forming a pressure point by inadvertently being positioned under the limb when not in active use, such as during transportation or other clinical procedures. Hence, it is advantageous if the tubing 14 connected to the connector 16 has sufficient length such that the garment connector 16 is positioned outside of the operational perimeter of the inflatable chamber(s) of the garment 10. One long connector embodiment of this disclosure, as shown by FIG. 12*b*, utilizes a tubing length between chamber(s) of the garment 10 and connector 16 of at least 40 mm in order to achieve this advantage.

It is even more advantageous if the tubing 14 is longer and, hence, the connector 16 is disposed to lie further outside of the operational perimeter of the garment. Thus, a further embodiment of this disclosure has a tubing length of at least 150 mm between chamber and connector in order to extend beyond the garment's operational perimeter.

A further parameter that is considered within this disclosure regards the length of the barrel mounted ferrite device 22. In order to allow ease of insertion into the connector barrel 18, the ferrite component 22 should have an appreciable length. If the length is too short, then there is insufficient compression achieved from the compressible ribs 19 on the internal surface of the connector barrel 18. This issue is conveniently described in terms of the ratio of length L to outside diameter De of the ferrite component 22, as illustrated in FIGS. 5*a* and 5*b*. It has been found to be advantageous that the length L of the ferrite component should be >30% of its outside diameter De in order to achieve a suitable level of retention and avoid the need for the use of alternative attachment means, e.g. an adhesive. In one embodiment of this disclosure, the longer ferrite component is made possible with the longer connector, which allows for an increased ratio length L to the outside diameter De of >100%.

A further embodiment of the invention involves an alternate manufacturing approach where the connector barrel 18, or the entire connector 16 itself, is itself constructed from either ferrite or brass and when it is inserted into the mating connector 50 the barrel 18 provides the same effect as the barrel-mounted component 22. A person skilled in the art would appreciate that this approach of replacing the barrel-mounted component with making the entire connector of the same material (e.g., ferrite doped plastic) falls within the scope of one or more embodiments of this disclosure. This integrated identifiable connector made of identification material (e.g., ferrite doped plastic) can be used either directly on a garment or as part of an extension device.

In accordance with an embodiment illustrated by FIG. 11*a*, an extension hose set connector 100 is adapted to accommodate longer garment connectors 16, but it does not read the identifiable component of the garment fluidic connector. On one end, the extension hose set connector 100 includes a mating-type connector 102 that is provided with a cavity 104. Cavity 104 is substantially similar to the cavity 52 in diameter and depth so that it can accommodate the longer barrel 18 of garment fluidic connector 16. The mating-type connector 102 is attached to a fluid tube 106 that connects the mating-type connector 102 to an extension fluidic connector 108, which has a barrel 110 dimensioned to hold identification component 112. The barrel 110 and identification component 112 are dimensioned and configured to be accommodated by a mating-type connector 150. In this way, the pump may identify the extension hose set connector 100, but not the garment type that is attached to the mating-type connector 102. Thus, the extension hose set connector 100 is an adaptor used to connect garment fluidic connectors 16 to pumps whose mating-type connector 150 can only accommodate garment fluidic connectors 116.

In accordance with an embodiment illustrated by FIG. 12*c*, a short extension device 120 includes a mating-type connector 102 that is connected directly to the extension fluidic connector 108 so that mating-type connector 102 is rigidly connected to extension fluidic connector 108. Thus, the short extension device 120 operates as an adaptor in the same way as the extension hose set connector 100 does, except that short extension device 120 is a shorter, rigid adaptor while the extension hose set connector 100 is a longer, flexible adaptor.

It also possible to arrange multiple connectors together in a group to form a plurality of individual paths. The advantages of the various embodiments detailed herein apply equally to a single or multiple air path and, hence, this is a further aspect of one or more embodiments of the present disclosure.

A further aspect of one or more embodiments of this disclosure relates to the marking of the components, such as the fluidic connector 16 and the tubing 14 present on the garment 10. In order to facilitate ease of set up and use, it is advantageous if the garments have certain aspects of their marking and color schemes that matches the marking on the associated part of the pump 40, 42, 44 they are connected to—e.g. each mating connector. This allows the user to further understand the intended connectivity and compatibility of the various system elements.

It is already generally well known for pumps to make use of specific visual marking cues on the fluid connectors that are intended for connection to the inflatable garments. This approach helps the user associate the connectors with the items to be connected and also differentiate between the multiple connectors present on the pump.

Examples of this use of visual cues to create this affinity include color coding each connector with differing identification colors, such as blue and orange components. It is also known to use marking with characters, such as letters or numbers (for example 'L' or 'R' to denote Left and Right or more simply '1' or '2'), mounted on the pump or hose set connectors. This marking feature is included to provide a direct association between the connector(s), the connected item(s), and the messages displayed on a liquid-crystal display (LCD) screen of the pump. This association is useful to allow the user to confirm the validity of the system connection, or to understand and differentiate error indicators that are specific to an individual garment (e.g. low pressure/leak). An aspect of one or more embodiments of this disclosure that achieves this affinity is through the use of colored garment tubing connected to the garment connector, for example, such as blue or orange tubing.

Therefore, a further aspect of this disclosure involves the extension of this marking concept to include these same visual elements on the garment and its constituent components. This can include the use of the same colors or markings used on the pump-based fluid connector, such as those connectors 52, 152 of FIGS. 8*b* and 8*d*, and on the garment-based fluidic connector 16, or other garment components such as the tubing 59, 159, grommets connecting the tubing to the inflatable chambers or the exterior of the garments. This can be easily achieved by the use of color additives in the plastic material used for the garment fluid connector—such as blue or orange tints. The garments themselves can also be marked with the same characters as already present on the pump or connecting hose based connections such as 'L', 'R', '1' or '2'.

It is also advantageous for the connector material to be a transparent color, or a semi-transparent color, so that it is possible to visually inspect for the presence of the identification component 22 present within the connector barrel 18, for example, during manufacturing or quality inspection. A further embodiment includes the use of a connector in a white color as this matches an existing known garment type manufactured by the applicant. Hence the advantages of embodiments of this disclosure can be utilized in combination with an existing feature.

A further embodiment includes the use of colored tubing within the garment assembly (e.g., in orange or blue colors) to match the colors already present on the associated pump connectors and thus allow the connector to remain in an optically clear material. While it can be useful in manufacturing to use common materials, there are benefits in the ability to provide the benefits of a color difference between garment types. The use of differing colored tube on differing garment types provides this benefit whilst having a minimal impact on manufacturing.

Alternative methods that are also within the scope of this disclosure include the use of secondary marking components such as collars, sleeves, labels or other secondary attached items that can be placed over the connector or tubing to provide the intended affinity between the various system components.

The information provided by the secondary marking component can include a range of aspects relating to the garment and its intended use.

This secondary marking component can be in the form of an additional attachable component, such as a collar or sleeves on the connector and/or its tubing as well as simpler labels.

The common trait is that the secondary marking component can be optionally added to an otherwise complete and functional garment to provide this marking benefit and the resultant visual association with the other system elements that are intended to be compatible with the garment, such as pump or connecting tubes.

The secondary marking component can include color coding to clearly associate the garment with compatible connectors on pumps intended for use with only specific types of garment. This coding also includes the use of various colors, text, graphics, icons, and 2D and 3D barcodes, which can be easily added to an otherwise standard garment to customize the garment further. The combination of these marking techniques on the marking component is, therefore, in the scope of the application.

One embodiment involves a simple color coded label attached to the garment connector tubing that utilizes blue or orange colors. These colors match the corresponding color markings already found on the applicants range of compatible connectors and products.

In addition, the label can also include additional specific information including, but not limited to, garment model number and size together with traceability information such as batch/lot or serial number. This secondary marking component can include information from the time of original manufacture of the garment, or can be updated and replaced as part of subsequent use of the garment post-manufacture and use. Typical examples of the use of this secondary marking component include product type identification, asset tracking, individual product identification, association with the use of other equipment, and also use with specific individual patients.

The benefits of the marking component are primarily intended for use by the garment supplier and its customers, but additional parties can also utilize the information. The marking on the component can, therefore, be selected to meet the requirements of entities such as hospital supply groups, individual medical establishments, other business accounts, specific hospital departments, parties and even recording the identity of individual patients.

A yet further embodiment involves the use of a label that indicates if the garment is being supplied in a specific state such as being sterile, sanitized or washed. The label color or displayed text can change state based on the process that the garment has been subjected to. It is known in the prior art that sensitive marker label materials can be used to indicate if a medical product has been sterilized by gamma radiation. In accordance with one or more embodiments of this disclosure, this approach is employed so that the indication of the garment sterility state is shown on the garment and not on the packaging, which is subject to disposal.

A further aspect of one or more embodiments of this disclosure involves the connectors having a defined color, as this can help associate the use of the product with a specific pump. So, for example, the use of white as a connector color is seen as being generic as this connector color is available off the shelf and, hence, can be readily purchased for use by multiple suppliers.

In accordance with one or more embodiments of this disclosure, the use of specific colors, such as orange, blue, and white, which match aspects of the color scheme used on the compatible pumps and current garments, may be employed.

Typically, garments are supplied as a pair, hence another embodiment includes the supply of a pair of garments where differing connector colors are used on the two garments, for example, one garment connector is colored blue and the other garment connector is colored orange.

In accordance with one or more embodiments of this disclosure, the garment may have manufacturing information laser printed on the tubing. This is beneficial as the connector is specifically intended to be physically small and there is, therefore, limited space available to allow this information to be printed onto the connector in a suitable location. The connector and tubing are typically assembled together as a sub-assembly, therefore, it is beneficial to record suitable manufacturing information, such as lot number, date of manufacturing and model number, on the tubing itself. Further information can be printed onto the tubing attached to the connector, such as model numbers, patient safety information, and material recycling information.

The inflatable garment, consists of a number of component parts each having differing materials. For example, the connector 116 is typically formed from a thermoplastic, the identification component 122 from either brass or ferrite, the connector tubing utilizes polyurethane (PU), the inflatable bladder PU or PVC, and the patient contacting material is typically in the form of polyester or a knitted yarn. Hence, there is an advantage in being able to easily separate these component parts for later separation, recycling and where necessary controlled disposal. This is of increased relevance as the connector 16 detailed with respect to embodiments of this disclosure includes a longer barrel and a longer internal component and, hence, utilize an increased amount of material. Therefore, it is a further aspect of one or more embodiments of this disclosure that the connector 16 utilizes a compression fit with the tubing to facilitate its easy removal from the tubing, and the longer barrel-mounted component 22 is fitted into the connector 16 using a compression fit or interference fit through the use of compressible ribs 19. The identification component 22 may be removed from the connector 16 using a hook-style tool that is inserted into the barrel 18 in order to pull the component out through the barrel and, hence, overcome the retention force provided by the compressible ribs. This approach ensures that all the materials can be simply disconnected from each other by pulling apart each component and also removes the need for additional materials, such as adhesive.

The invention claimed is:

1. An inflatable garment comprising:

at least one inflatable chamber;

a connecting fluid tube;

a garment fluid connector in fluidic connection with the at least one inflatable chamber via the connecting fluid tube, wherein the garment fluid connector includes a circular connector barrel that has a longitudinal length, an inside diameter and an outside diameter; and an identification component located inside the barrel, wherein the longitudinal length of the barrel is dimensioned to fluidically connect inside a universal mating connector and not with a non-universal mating connector wherein the identification component of the inflatable garment is a tube, and the tube comprises an inner diameter, an outer diameter, and a fluid path that extends a length of the tube and is defined by the inner diameter, wherein the outer diameter does not exceed two times the inner diameter.

2. An inflatable garment according to claim 1, wherein the universal mating connector has a cavity configured and dimensioned to join with the barrel to form a fluidic connection, whereas the non-universal mating connector has a cavity that is too shallow to join with the barrel to form a fluidic connection.

3. An inflatable garment according to claim 1, where the connector barrel comprises a plurality of compression ribs disposed on an inside surface of the barrel, wherein the plurality of compression ribs secure the identification component inside the barrel in a removable manner.

4. An inflatable garment according to claim 1, wherein a compression rib is located every 20-30 degrees along a circumference of the inside surface of the barrel so that the plurality of compression ribs contact approximately 30% of a circumferential area of an exterior surface of the identification component.

5. An inflatable garment according to claim 1, wherein the identification component is made of a material selected from the group consisting of a ferrite material and a brass material.

6. An inflatable garment according to claim 1, wherein the identification component has a length that is greater than 4 mm and no greater than 13 mm.

7. An inflatable garment according to claim 1, wherein the outside diameter of the barrel is less than 15 mm.

8. An inflatable garment according to claim 1, wherein the identification component has a toroidal configuration with rounded edges and a length that exceeds 6 mm.

9. A method of connecting an inflatable garment to a set of pumps operable to inflate an inflatable garment, the method comprising the steps of:

inserting the garment fluid connector of the inflatable garment of claim 1 into a mating-type connector of a pump, wherein when the mating-type connector is a universal connector, then connecting the garment fluid connector to the universal connector to form a fluidic connection; and sensing the identification component with a sensor to identify the inflatable garment.

10. A method according to claim 9, wherein when the mating-type connector is a non-universal connector, then the inflatable garment and the pump do not form a fluidic connection.

11. A method according to claim 9, wherein when the sensor senses the identification component, operating the pump to inflate one or more chambers of the inflatable garment only when the pump is able to identify the inflatable garment as a compatible garment.

12. A method of connecting an inflatable garment to a set of pumps operable to inflate an inflatable garment, the method comprising the steps of:

inserting the garment fluid connector of the inflatable garment of claim 1 into a mating-type connector of a pump, wherein when the mating-type connector is a universal connector, then connecting the garment fluid connector to the universal connector to form a fluidic connection;

sensing the identification component with a sensor to identify the inflatable garment; and ascertaining a first mark associated with the garment fluid connector of the inflatable garment and a second mark associated with the mating-type connector of the pump before inserting the garment fluid connector into the mating-type connector, and inserting the garment fluid connector into the mating-type connector only when the first mark and the second mark indicate compatibility.

13. A method according to claim 12, wherein the first mark and the second mark have the same color.

14. A method according to claim 12, wherein the first mark and the second mark have the same number or letter.

* * * * *